US005199623A

United States Patent [19]

Rajala et al.

[11] Patent Number: 5,199,623

[45] Date of Patent: Apr. 6, 1993

[54] DEVICE FOR SUPPORTING, TURNING AND SPREADING OF A WEB

[75] Inventors: Raimo Rajala, Kaarina; Jukka Parvinen, Turku; Bertel Karlstedt, Parainen; Pertti Heikkilä, Raisio; Ilkka Jokioinen, Lieto, all of Finland

[73] Assignee: Valmet Paper Machinery Inc., Finland

[21] Appl. No.: 694,799

[22] Filed: May 2, 1991

Related U.S. Application Data

[63] Continuation of Ser. No. 455,591, Dec. 22, 1989, abandoned.

[30] Foreign Application Priority Data

Jan. 6, 1989 [FI] Finland ..... 890077

[51] Int. Cl.[5] ..... B65H 20/14

[52] U.S. Cl. ..... 226/97; 226/196; 34/156

[58] Field of Search ..... 226/7, 95, 97, 196, 226/197; 34/156, 160

[56] References Cited

U.S. PATENT DOCUMENTS

| | | | |
|---|---|---|---|
| 3,279,091 | 10/1966 | Freuler | 34/156 |
| 4,218,833 | 8/1980 | Coar | 226/97 X |
| 4,288,015 | 9/1981 | Curtain | 226/97 |
| 4,698,914 | 10/1987 | Shi et al. | 226/97 X |
| 4,848,633 | 7/1989 | Hagen et al. | 226/97 |

*Primary Examiner*—Daniel P. Stodola
*Assistant Examiner*—Paul Bowen
*Attorney, Agent, or Firm*—Steinberg & Raskin

[57] ABSTRACT

A device for contact-free supporting, turning, and spreading of a paper web, comprises a face (K) curved in accordance with the turning of the web (W), in connection with which face (K) the web (W) runs supported by air blown in between the face (K) and the web (W). The nozzle members in the device comprise guide faces (28a, 28b) and carrier faces (27, 37) placed in connection with the guide faces, air being blown through nozzle slots (26a,26b,36) in the nozzle members, transverse to the direction of running of the web (W), onto the carrier faces (27,37). The nozzle slots (26a,26b,36) are, from one side, defined by the guide faces (28,28b,38). The air-supported face (K) in the device is defined by carrier faces (27,37) substantially parallel to the run of the web (W) to be supported, provided at float-nozzle boxes (20) and at foil-nozzle boxes (30). In the direction of running of the web (W), the first nozzle box and the last nozzle box are float-nozzle boxes (20), in which the nozzles (26a,26b) that flow ($F_1$) against each other produce pressurized carrier faces (K+). Between the float-nozzle boxes (20), there are one or several foil-nozzle boxes (30). Between the nozzle boxes (20,30), there are pressure equalization pockets (18).

11 Claims, 2 Drawing Sheets

DEVICE FOR SUPPORTING, TURNING AND SPREADING OF A WEB

This is a continuation of application Ser. No. 07/455,591, filed Dec. 22, 1989, now abandoned.

BACKGROUND OF THE INVENTION

The invention concerns a device for contact-free supporting, turning and spreading of a web, in particular of a coated paper or board web, which device consists of a face curved in accordance with the turning of the web, in connection with which face the web runs supported by air blown in between said face and the web, the nozzle members in the device comprising guide faces and carrier faces placed in connection with the guide faces, gas, such as air, being blown through nozzle slots in the nozzle members, transverse to the direction of running of the web, onto the carrier faces, and which nozzle slots are, from one side, defined by the guide faces or placed in proximity to the faces.

With respect to the prior art related to the present invention, reference is made to the EP Patent Application 87102411.3, to the EP Patent Application 83303143.8, and to the U.S. Pat. No. 4,218,833.

With respect to some typical applications to use of the devices in accordance with the invention, reference is made to the Applicant's FI Patent 67,586 (equivalent of CA Patent No. 1,221,569).

With respect to the prior art most closely related to the present invention, reference is made to the device, described in the Applicant's FI Patent 64,335, in particular for contact-free supporting, spreading, and for possible turning of a coated paper or board web, which device's nozzle members consist of curved guide faces and of a pressure face placed between them, at both sides of which the pressure face nozzle slots are placed whose longitudinal direction is transverse to the direction of running of the web. In the FI Pat. 64,335 it is novel that the ratio of the width of the nozzle slots to the curve radius of the guide face is chosen in such a way that, with the occurring flow rates, the gas flow follows along with the curved guide face up to the pressure face and that the defining edges of the nozzle openings at the intermediate faces are sharp-angled to prevent turning of the gas flow onto the intermediate faces.

OBJECTS AND SUMMARY OF THE INVENTION

The main object of the present invention is to avoid the drawbacks that have occurred in the prior-art devices and to develop the device described in said FI Patent 64,335 further so that the deficiencies noticed in it in practice are amended. In the device in accordance with the FI Patent 64,335 it has been a drawback that by its means it has not been possible to produce the desired spreading effect in the web or an adequate guiding effect in the transverse direction in all applications, but in the area of the device it has been possible to form folds in the web in the transverse direction.

In studies carried out on test runs and test machines, it has been noticed that an uneven tension of the web makes the run of the web considerably more difficult. Also, in some prior-art turning devices in production machines, attempts have been made to take this factor into account by attaching of force detectors to the fastening points of the device. In such a case, by observing the displays, the operating personnel have been able to perform necessary changes in the tension and run of the web. The prior-art devices are not provided with pressure regulation mechanisms per se, but the adjustments are carried out by changing the positions of the device or of rolls.

Another object of the present invention is to provide a device that has a more efficient effect in spreading and guiding the web.

A further object of the invention is to provide a device wherein the requirement of air is lower than in corresponding prior-art devices.

A non-indispensable additional object of the present invnetion is to provide a device that eliminates web running problems resulting from uneven tension of the web.

A non-indispensable additional object of the present invention is to provide a device in which it is possible to arrange removal of the blow air such that, through the nozzles in the device, dry and hot air can be blown so as to dry the material web to be supported and turned.

In view of achieving the objections stated above and those that will come out later, the invention is characterized in that the air-support face in the device is defined by carrier faces substantially parallel to the web to be supported, provided at float-nozzle boxes and at foil-nozzle boxes, that the device includes float-nozzle boxes as the first nozzle box and as the last nozzle box in the direction of running of the web, the nozzles that blow against each other in each of said boxes producing a pressurized carrier face, and that between said float-nozzle boxes, there are one or several foil-nozzle boxes, and that between said nozzle boxes, there are pressure equalization pockets.

The device in accordance with the invention is intended for contact-free air-supporting, simultaneous spreading, and turning of a paper or board web. In the device in accordance with the invention, the turning angle may vary within relatively wide limits, e.g., within a range of zero to 180°, although preferable applications of the invention are within a turning-angle range of a=60°-180°. The value of the turning angle a=zero means that the web is not turned at all, but the device operates merely as a contact-free spreading and supporting device, in which application all of the advantages of the invention do not come out, at least not to their full extent.

The foil nozzles used in the invention spread the web in the transverse direction and prevent formation of folds in the web. The foil nozzles, for their part, lower the consumption of air, in particular because in the lateral area the air moves substantially parallel to the web. A blowing directed against the direction of running of the web prevents extrusion of air from the outlet side. The air entering along with the web from the inlet side, for its part, produces a sealing effect.

In the invention, there are pressure pockets preferably between the nozzles, these pockets, being of sufficiently large volume, keeping the pressure between the web and the turning device invariable even if disturbances at the web are considerable. The pressure pockets between the nozzles are preferably connected to the same pressure chamber, and since the pressures in the pressure pockets are equal, the distance of the web from the turning device remains invariable.

If necessary, the turning device in accordance with the invention may also be used as a dryer, because moist circulation air can be removed out of the pressure chamber. For its part, the little leakage of air out of the device into the machine housing also permits the use of heated air.

In an advantageous embodiment of the invention, the edges of the pressure pockets are provided with nozzle-type sealing of the edges, which for its part lowers the leakage of air at the edges.

In the device of the invention, it is advantageous to use transverse regulation of pressure, whereby it is possible to eliminate the difficulties in the draw of the web that result mainly from uneven transverse web tension.

In the following, the invention will be described in detail with reference to some advantageous exemplifying embodiments of the invention shown in the figures in the accompanying drawing, the invention being by no means strictly confined to the details of these embodiments.

DESCRIPTION OF THE PREFERRED EMBODIMENTS

Figure 1:
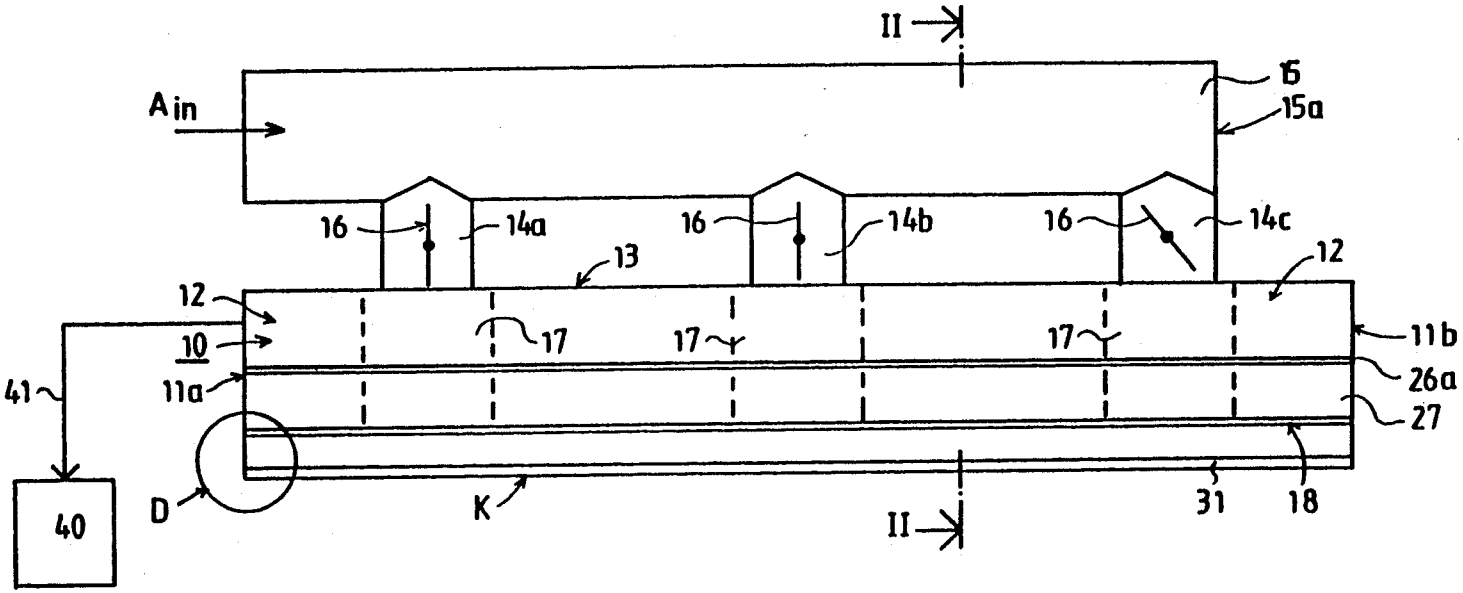
FIG. 1 is an elevational view of a device in accordance with the invention as seen in the machine direction.
Figure 2:
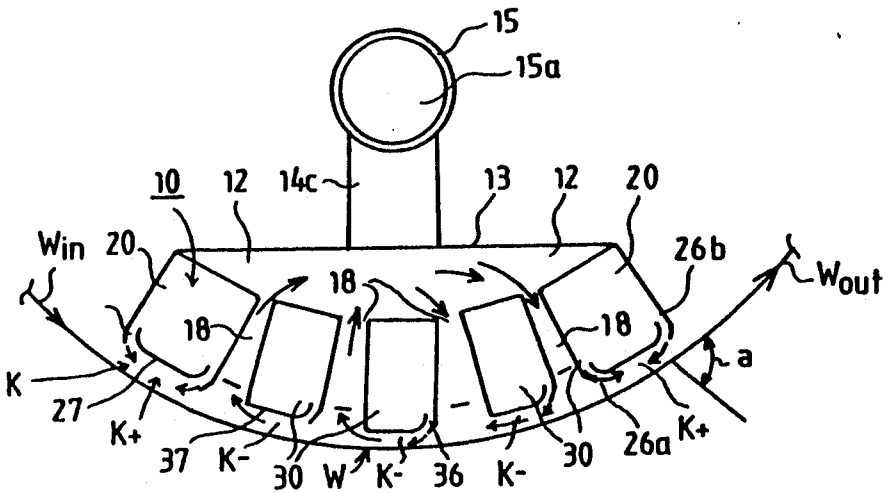
FIG. 2 is a vertical sectional view along the line II—II of FIG. 1.

The overall construction of the operation of the device in accordance with the invention is shown in FIGS. 1 and 2. The device includes a set of nozzle boxes 10, whose nozzle boxes 20,30 are interconnected by means of ends 11*a* and 11*b* as well as by means of a planar plate 13. Into the set of nozzle boxes 10, the blow air required on its curved carrier face K is introduced through the pipes 14*a*,14*b* and 14*c*, these pipes communicating with an air inlet duct 15. The blow air is passed into the inlet duct 15, which is provided with a closed end 15*a*, from a blower (not shown) in the direction of the arrow $A_{in}$) From the pipes 14*a*,14*b*,14*c*, provided with regulation dampers 16, the blow air streams are passed through the blocks 17 into the interior 23,33 of the nozzle boxes 20,30.

As is shown in FIG. 2, the moist web W to be supported and turned free of contact, usually coated at one side or both sides, is brought in the direction of the arrow $W_{in}$ from a coating device, size press, or equivalent. The web $W_{out}$ leaves the device after it has run over its carrier face K and after it has turned over the angle a. The angle a may vary within a range of a=zero to 180°. As a rule and most appropriately, the turning angle a is within the range of a=60° to 180°. The number of nozzle boxes 20,30 needed in the device depends on the turning angle a.

Figure 3:
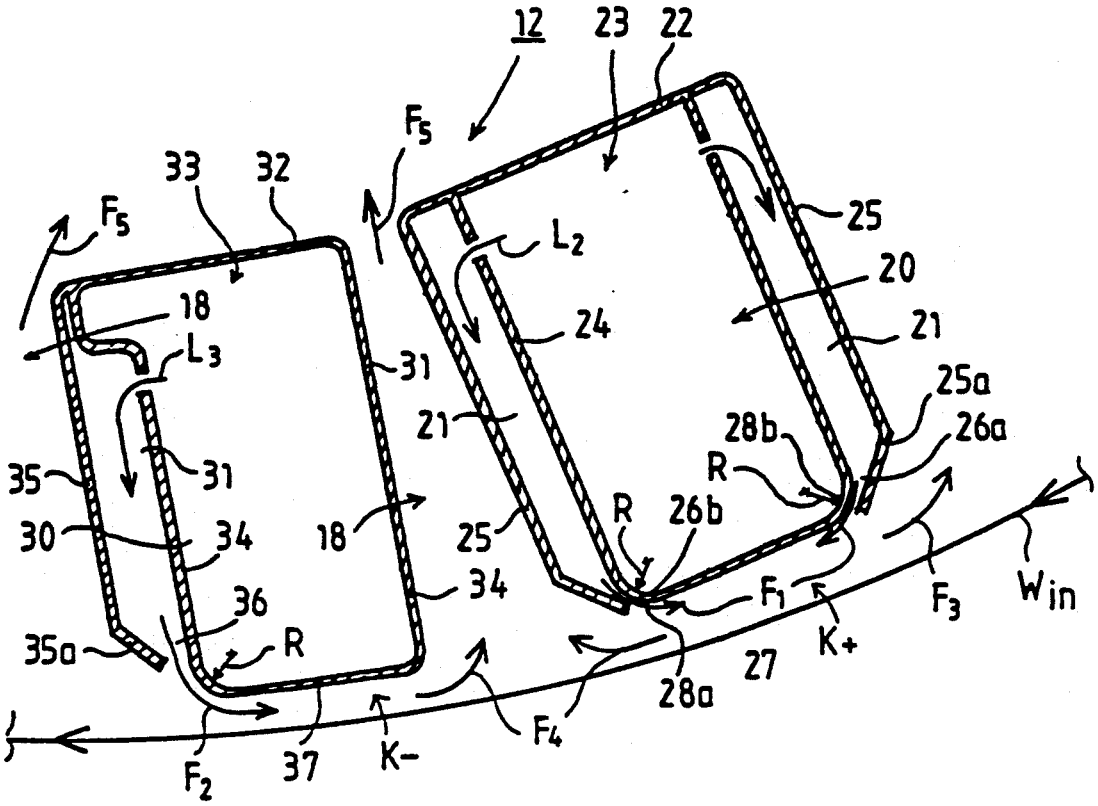
FIG. 3 is a vertical sectional view of two nozzle boxes in the device of the invention, the boxes being the first two nozzle boxes in the direction of arrival of the web.

As is shown in FIGS. 1 and 2, in the device the first nozzle box is a pressurized so-called float-nozzle box 20, a similar nozzle box being also provided as the last nozzle box in the device. Between the pressurized nozzle boxes 20 there are three foil-nozzle boxes 30 with negative pressure, as is shown in FIG. 3. The number of the foil-nozzle boxes 30 is, as a rule, 1–6, depending on the turning angle a. In some special applications, if the turning angle a is very large, a third float-nozzle box 20 may be placed between the foil-nozzle boxes 30.

It is an essential feature of the invention that between the nozzle boxes 20 and 30 there are relatively wide open intermediate spaces 18, which operate as pressure pockets and which communicate with a pressure equalization chamber 12, which extends in the transverse direction across the entire width of the web W and by whose means it is possible to control the problems of draw resulting from uneven tension of the web W.

Figure 4:
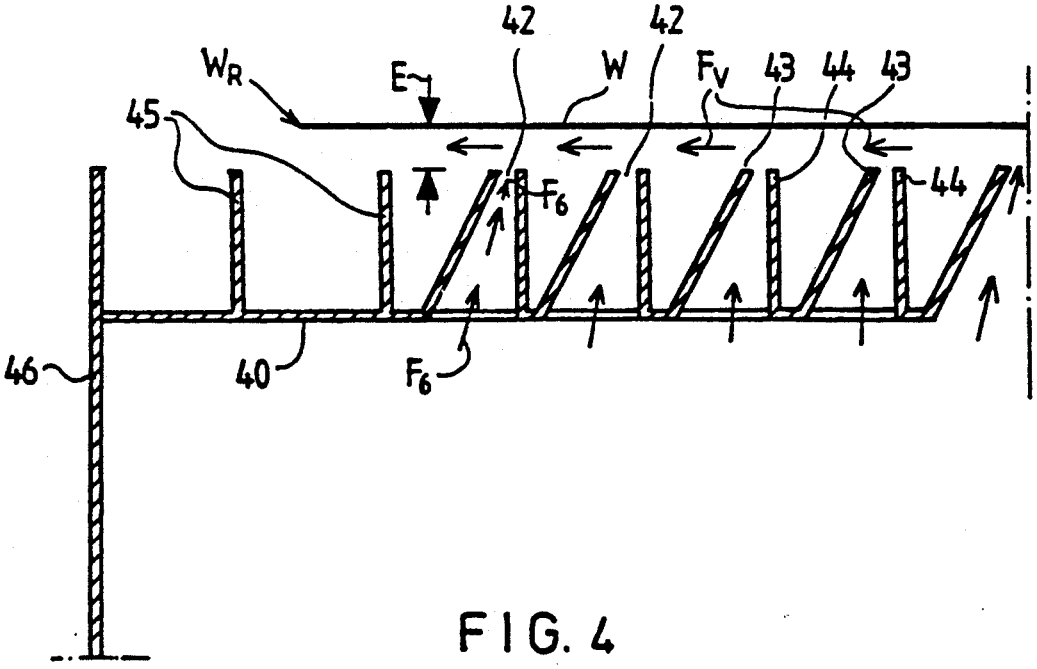
FIG. 4 is a transverse vertical sectional view of the sealing arrangement at the edge of the web, i.e. of the detail D in FIG. 1.

As is shown in FIG. 3, the pressurized float-nozzle boxes 20 comprise side walls 24,25 and a bottom wall 22, the side walls 25 and 24 defining lateral ducts 21 between them. The outer side of the float-nozzle boxes 20 is a substantially plane carrier face 27, at both sides joining Coanda faces 28*a* and 28*b* of a curve radius R, plane folded portions 25*a*,25*b* being placed opposite to the Coanda faces. The carrier faces 27 may also be concave, i.e. they may have recesses when seen from outside. The nozzle parts 25*a*,28*a* and 25*b*,28*b* define nozzles 26*a* and 26*b* between them, blowings $F_1$ directed against each other being blown through the nozzles 26*a* and 26*b*. Into the lateral boxes 21, the blow air is introduced in the direction of the arrows $L_2$ from the interior 23 of the nozzle boxes 20, into which the air flows through the ducts 17. On the carrier faces 27 of the carrying zone K, the blowings $F_1$ produce a zone of positive pressure K+, from which the air is discharged to the inlet side $W_{in}$ of the web W outwards in the direction of the arrow $F_3$ as well as outwards at both sides of the web W in the direction of the arrows $F_v$ (FIG. 4).

The foil boxes 30 comprise side walls 34,35, a bottom wall 32, and a carrier-face wall 37. The foil boxes 30 contain a lateral duct 31, which is defined by the side walls 34 and 35. As an extension of the wall 35, there is a folded portion 35*a*, which defines the nozzle slot 36 together with the inner wall 34 and the curved Coanda face 38, which constitutes a direct extension of the inner wall 34. Through the nozzle slot 36, blowings $F_2$ are directed, which, guided by the Coanda face 38, are turned so that they become parallel to the carrier face 37; the blowings $F_2$ are directed as contrary to the direction of running of the web W. The blow air is passed into the interior 33 of the foil boxes 30 through the ducts 17, and from the interior space 33 the blow air enters in the direction of the arrow $L_3$ into the lateral ducts 31 and from there further, as foil blowings $F_2$, onto the carrier face 37.

The blowings $F_2$ produce fields of negative pressure K- by means of the foil effect. Out of the fields of negative pressure K-and out of the fields of positive pressure K+, air flows are sucked in the direction of the arrows $F_4$ into the intermediate spaces 18 and from there further in the direction of the arrows $F_5$ into the pressure equalization chamber 12.

In the transverse direction of the web W, the blow boxes 20 and 30 are divided, for example, into three blocks by means of transverse partition walls. Each block receives its own blow air through its respective inlet duct 14*a*,14*b*,14*c*. The quantity of blow air passed into each block can be controlled by means of regulation dampers 16. By means of this regulation, the run of the web W can be stabilized, and problems of draw resulting from variations in the web tension can be eliminated. Owing to the regulation described herein, it is not necessary to change the position of the device or to measure the forces applied to the device.

One essential feature of the invention is the employment of a pressure equalization chamber 12. The chamber 12 extends across the entire width of the set of nozzle boxes 10 and the web W, i.e. between the end walls 11*a*,11*b*. The chamber 12 and the intermediate spaces 18, of relatively large volume, cause the distance of the web W from the system of carrier faces 27,37 in the turning device to remain substantially invariable in spite of variations in the web tension.

If necessary, removal of air out of the pressure chamber 12 is arranged so that moist circulation air can be removed out of the chamber 12. This removal is illustrated by the blower 40 and the exhaust pipe 41 shown schematically in FIG. 1. In such a case, the device can be used as a dryer when dry and hot air is supplied into the device through the duct 15.

FIG. 4 shows the detail D in FIG. 1, i.e. the sealing arrangement in the lateral area $W_R$ of the web W. A corresponding sealing arrangement is provided at the opposite edge of the web W. The set of boxes 10 includes a wall 40. The walls 43 and 44 define a nozzle 42 between them, these nozzles extending over the entire length of the carrier face K, i.e. over the sector a in the machine direction, or diagonally against said sector. The blow direction $F_6$ of the nozzles 42 is towards the middle area of the web W, i.e. against the leakage flows $F_V$. At the inside of the nozzle 42, a labyrinth seal is arranged, which consists of plates 43 and 44 directed in, or inclined in relation to, the machine direction, said labyrinth seal reducing the leakage flow $F_V$ together with the blowings $F_6$. The edges of the seals 43 and 44 will have a certain distance E from the web W. Thus, the edges of the seals 34 and 44 have the same curve form as the turning sector a of the web. The outermost parts of the seal arrangement shown in FIG. 4 consist of the outside wall 46 placed in the machine direction and of a partition wall 45, which is placed facing the web edge $W_R$.

The invention is not limited to the preferred embodiment herein described and numerous other embodiments within the scope of the appended claims will readily occur to those skilled in the art.

What is claimed is:

1. A device for contact free air supporting, turning and spreading of a web, said device comprising:

a curved carrier face, said face shaped in dependence upon a turning angle of a web placed in close proximity thereto, a plurality of interconnected nozzle boxes for blowing air to support said web, each nozzle box having a plurality of sides, one of said sides having at least one end separated by a gap from a side adjacent thereto, said one of said sides and said side adjacent thereto being shaped so as to define a nozzle oriented such that a gas in said nozzle box can flow therethrough, and one of said sides being substantially parallel to the run path of said web to form a boundary of said curved carrier face, and wherein some of said nozzle boxes are float-nozzle boxes, and said float-nozzle boxes are situated such that at least one foil-nozzle box is interposed between adjacent said float-nozzle boxes and pressure equalization pockets are created between adjacent nozzle boxes, a single web floating pressure equalization chamber extending in a transverse direction substantially across the entire width of the web, said single web floating pressure equalization chamber being arranged downstream after said nozzles in the direction of air flow through said nozzles, said pressure equalization pockets provided between said adjacent nozzle boxes directly communicating with said single web floating pressure equalization chamber, each said nozzle box having its interior separated from said single web floating pressure equalization chamber, said single web floating pressure equalization chamber and said pressure equalization pockets being structured and arranged to circulate the air to keep the pressure between said web and said turning device substantially invariable in spite of disturbances in the web due to uneven tension thereof, such that the distance between said web and said curved carrier face is kept substantially invariable.

2. A device as claimed in claim 1 wherein, in connection with said nozzles of the float nozzle boxes and of the foil-nozzle boxes, said at least one end comprises a curved face which is formed so as to turn the air flowing through said nozzle onto said curved carrier face and said side adjacent thereto.

3. A device as claimed in claim 2, wherein said foil-nozzle boxes comprise, at one end of said one of said sides, said nozzle being a Coanda nozzle, whose direction of blowing is opposite to the direction of running of the web.

4. A device as claimed in claim 2, wherein the foil-nozzle boxes comprise, at one of their edges, Coanda nozzles, whose direction of blowing is parallel to the direction of running of the web.

5. A device as claimed in claim 1 wherein said foil-nozzle boxes comprise, at one end of said one of said sides, said nozzle being a Coanda nozzle, whose direction of blowing is opposite to the direction of running of the web.

6. A device as claimed in claim 1, wherein the foil-nozzle boxes comprise, at one of their edges, said nozzle being a Coanda nozzle, whose direction of blowing is parallel to the direction of running of the web.

7. A device as claimed in claim 1, wherein, depending on its turning angle, the device comprises at least one of said foil-nozzle boxes placed between adjacent float-nozzle boxes.

8. A device as claimed in claim 1, wherein the blowing directed out of a nozzle opening at an outer edge of a terminal float-nozzle box is arranged to prevent extrusion of air at the outlet side of said carrier face and the air coming along at the inlet side of the web functions to seal the curved carrier face.

9. A device as claimed in claim 1, wherein said pressure equalization pockets are each connected to a single pressure chamber which extends substantially across the entire width of the web by means of which the disturbance of the web from such curved carrier face of the turning device is kept substantially invariable.

10. A device as claimed in claim 1, further comprising said web and said nozzle-type lateral sealings, which function to lower the leakage flows at said edges of said web.

11. A device as claimed in claim 1, wherein the device comprises an arrangement for transverse regulation of pressure, said arrangement constructed by dividing the nozzle boxes into blocks in the transverse direction of the web, into each of which blocks an air flow of adjustable quantity or pressure can be passed, such that by means of said pressure regulation the run of the web and the distance of the web from the curved carrier face are stabilized against variations in web tension.

* * * * *